US010634426B2

(12) United States Patent
Lourenco et al.

(10) Patent No.: US 10,634,426 B2
(45) **Date of Patent: *Apr. 28, 2020**

(54) METHOD TO PRODUCE LIQUEFIED NATURAL GAS (LNG) AT MIDSTREAM NATURAL GAS LIQUIDS (NGLS) RECOVERY PLANTS

(71) Applicants: 1304342 Alberta Ltd, Edmonton (CA); 1304338 Alberta Ltd, Edmonton (CA)

(72) Inventors: Jose Lourenco, Edmonton (CA); MacKenzie Millar, Edmonton (CA)

(73) Assignees: 1304338 Alberta Ltd, Edmonton (CA); 1304342 Alberta Ltd, Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/722,910

(22) Filed: Dec. 20, 2012

(65) Prior Publication Data

US 2013/0152627 A1 Jun. 20, 2013

(30) Foreign Application Priority Data

Dec. 20, 2011 (CA) ..... 2763081

(51) Int. Cl.
*F25J 3/02* (2006.01)
*F25J 1/00* (2006.01)

(52) U.S. Cl.
CPC ..... *F25J 1/0022* (2013.01); *F25J 3/0209* (2013.01); *F25J 3/0233* (2013.01); *F25J 3/0238* (2013.01);
(Continued)

(58) Field of Classification Search
CPC ..... F25J 3/0241; F25J 3/0223; F25J 3/0233; F25J 3/0238; F25J 3/0209; F25J 2280/02;
(Continued)

(56) References Cited

U.S. PATENT DOCUMENTS 2,168,438 A 8/1939 Carrier
3,002,362 A 10/1961 Morrison
(Continued)

FOREIGN PATENT DOCUMENTS

CA 1 048 876 2/1979
CA 2 299 695 A1 3/1999
(Continued)

OTHER PUBLICATIONS

Hudson et al., Reducing Treating Requirements for Cryogenic NGL Recovery Plants (Pre-Print), Mar. 12, 2001.*
(Continued)

*Primary Examiner* — Brian M King
(74) *Attorney, Agent, or Firm* — Christensen O'Connor Johnson Kindness PLLC

(57) ABSTRACT

A method for production of liquid natural gas (LNG) at natural gas liquids (NGLs) recovery plants that maximizes NGLs recovery by producing LNG and using the produced LNG as an external cooling source to control the operation of a de-methanizer column at the NLG recovery facility. In at least one embodiment, LNG is added from an LNG overhead receiver by direct mixing to control the temperature profile in the NGL de-methanizer column. The temperature in an overhead product of the de-methanizer column is controlled by controlling addition of LNG as a reflux stream. The temperature in an expanded feed gas to the de-methanizer column is controlled by controlling addition of LNG as a tempering gas, while stripping of carbon dioxide from an NGL product stream is controlled by controlling the addition of LNG as stripping gas.

11 Claims, 2 Drawing Sheets

(52) U.S. Cl.
CPC ..... *F25J 2200/02* (2013.01); *F25J 2200/74* (2013.01); *F25J 2205/04* (2013.01); *F25J 2215/04* (2013.01); *F25J 2220/04* (2013.01); *F25J 2220/66* (2013.01); *F25J 2240/02* (2013.01); *F25J 2245/02* (2013.01); *F25J 2270/02* (2013.01); *F25J 2270/04* (2013.01); *F25J 2280/02* (2013.01)

(58) Field of Classification Search
CPC .. F25J 2200/02; F25J 2200/74; F25J 2205/04; F25J 2215/04; F25J 2220/04
USPC ..... 62/618, 619, 620, 621, 622
See application file for complete search history.

(56) References Cited

U.S. PATENT DOCUMENTS

| | | | | |
|---|---|---|---|---|
| 3,152,194 | A | 10/1964 | Pohl | |
| 3,184,926 | A | 5/1965 | Blake | |
| 3,367,122 | A * | 2/1968 | Tutton | F17C 9/04 62/630 |
| 3,754,405 | A | 8/1973 | Rosen | |
| 3,792,590 | A | 2/1974 | Lofredo | |
| 3,846,993 | A | 11/1974 | Bates | |
| 3,859,811 | A | 1/1975 | Duncan | |
| 4,279,130 | A | 7/1981 | Finch | |
| 4,424,680 | A | 1/1984 | Rothchild | |
| 4,430,103 | A | 2/1984 | Gray | |
| 4,444,577 | A * | 4/1984 | Perez | 62/622 |
| 4,617,039 | A | 10/1986 | Buck | |
| 4,681,612 | A * | 7/1987 | O'Brien | B01D 53/22 62/624 |
| 4,710,214 | A * | 12/1987 | Sharma et al. | 62/621 |
| 4,751,151 | A | 6/1988 | Healy | |
| 5,062,270 | A * | 11/1991 | Haut | F25J 3/0209 62/629 |
| 5,137,558 | A | 8/1992 | Agrawal | |
| 5,295,350 | A | 3/1994 | Child | |
| 5,329,774 | A | 7/1994 | Tanguay | |
| 5,440,894 | A | 8/1995 | Schaeffer | |
| 5,678,411 | A | 10/1997 | Matsumura | |
| 5,685,170 | A | 11/1997 | Sorensen | |
| 5,956,971 | A * | 9/1999 | Cole | F25J 1/0202 62/623 |
| 6,089,022 | A | 7/2000 | Zednik | |
| 6,131,407 | A | 10/2000 | Wissolik | |
| 6,182,469 | B1 * | 2/2001 | Campbell et al. | 62/621 |
| 6,266,968 | B1 | 7/2001 | Redlich | |
| 6,432,565 | B1 | 8/2002 | Haines | |
| 6,517,286 | B1 | 2/2003 | Latchem | |
| 6,526,777 | B1 * | 3/2003 | Campbell | F25J 1/0201 62/621 |
| 6,640,555 | B2 | 11/2003 | Cashin | |
| 6,662,589 | B1 | 12/2003 | Roberts | |
| 6,889,523 | B2 * | 5/2005 | Wilkinson | F25J 1/0201 62/613 |
| 6,932,121 | B1 | 8/2005 | Shivers, III | |
| 6,945,049 | B2 | 9/2005 | Madsen | |
| 7,107,788 | B2 | 9/2006 | Patel | |
| 7,155,917 | B2 | 1/2007 | Baudat | |
| 7,219,502 | B2 | 5/2007 | Nierenberg | |
| 7,257,966 | B2 | 8/2007 | Lee | |
| 7,377,127 | B2 | 5/2008 | Mak | |
| 2002/0170297 | A1 | 11/2002 | Quine | |
| 2003/0008605 | A1 | 1/2003 | Hartford, Jr. | |
| 2003/0019219 | A1 | 1/2003 | Viegas | |
| 2003/0051875 | A1 | 3/2003 | Wilson | |
| 2003/0196452 | A1 | 10/2003 | Wilding | |
| 2004/0065085 | A1 | 4/2004 | Madsen | |
| 2005/0086974 | A1 | 4/2005 | Steinbach | |
| 2005/0244277 | A1 | 11/2005 | Hurst, Jr. | |
| 2006/0242970 | A1 | 11/2006 | Yang | |
| 2008/0016910 | A1 | 1/2008 | Brostow | |
| 2009/0113928 | A1 | 5/2009 | Vandor | |
| 2009/0249829 | A1 * | 10/2009 | Lourenco | C10L 3/10 62/632 |
| 2009/0282865 | A1 * | 11/2009 | Martinez | F25J 3/0209 62/620 |
| 2011/0036122 | A1 * | 2/2011 | Betting | B01D 53/24 62/636 |
| 2011/0174017 | A1 * | 7/2011 | Victory | F25J 3/0209 62/620 |

FOREIGN PATENT DOCUMENTS

| | | | |
|---|---|---|---|
| CA | 2 318 802 | A1 | 8/1999 |
| CA | 2 467 338 | A1 | 7/2003 |
| EP | 0 482 222 | A1 | 4/1992 |
| EP | 0 780 649 | A1 | 6/1997 |
| JP | 5-263998 | A | 10/1993 |
| JP | 2002-295799 | A | 10/2002 |
| RU | 2 232 342 | C1 | 7/2004 |
| WO | 97/01069 | A1 | 1/1997 |
| WO | 98/59205 | A2 | 12/1998 |
| WO | 03/095913 | A1 | 11/2003 |
| WO | 03/095914 | A1 | 11/2003 |
| WO | 2004/010480 | A1 | 1/2004 |
| WO | 2004/109180 | A1 | 12/2004 |
| WO | 2004/109206 | A1 | 12/2004 |
| WO | 2005/045337 | A1 | 5/2005 |
| WO | 2006/004723 | A1 | 1/2006 |
| WO | 2006/019900 | A1 | 2/2006 |
| WO | 2006/036441 | A1 | 4/2006 |
| WO | 2009/061777 | A1 | 5/2009 |

OTHER PUBLICATIONS

International Preliminary Report on Patentability dated Mar. 5, 2013, issued in corresponding International Application No. PCT/CA2012/050030, filed Jan. 18, 2012, 6 pages.

International Search Report and Written Opinion dated May 1, 2012, issued in corresponding International Application No. PCT/CA2012/050030, filed Jan. 18, 2012, 9 pages.

* cited by examiner

METHOD TO PRODUCE LIQUEFIED NATURAL GAS (LNG) AT MIDSTREAM NATURAL GAS LIQUIDS (NGLS) RECOVERY PLANTS

FIELD

The present disclosure relates to a method for production of liquid natural gas (LNG) at midstream natural gas liquids (NGLs) recovery plants. More particularly, the present disclosure provides methods to efficiently and economically produce LNG at NGL recovery plants.

BACKGROUND

Natural gas from producing wells contains natural gas liquids (NGLs) that are commonly recovered. While some of the needed processing can be accomplished at or near the wellhead (field processing), the complete processing of natural gas takes place at gas processing plants, usually located in a natural gas producing region. In addition to processing done at the wellhead and at centralized processing plants, some final processing is also sometimes accomplished at Midstream NGLs Recovery Plants, also known as "straddle plants." These plants are located on major pipeline systems. Although the natural gas that arrives at these straddle plants is already of pipeline quality, there still exists quantities of NGLs, which are recovered at these straddle plants.

The straddle plants essentially recover all the propane and a large fraction of the ethane available from the gas before distribution to consumers. To remove NGLs, there are three common processes; refrigeration, lean oil absorption, and cryogenic.

The cryogenic processes are generally more economical to operate and more environmentally friendly; current technology generally favors the use of cryogenic processes over refrigeration and oil absorption processes. The first-generation cryogenic plants were able to extract up to 70% of the ethane from the gas; modifications and improvements to these cryogenic processes over time have allowed for much higher ethane recoveries (>90%).

SUMMARY

The present disclosure provides a method for maximizing NGLs recovery at straddle plants and producing LNG. The method involves producing LNG and using the produced LNG as an external cooling source to control the operation of a de-methanizer column. According to at least one embodiment, the method furthers the production of ethane and generates LNG.

As will hereinafter be further described, the production of LNG is determined by the flow of a slipstream from the de-methanizer overhead stream in an NGL recovery plant. An NGLs recovery plant de-methanizer unit typically operates at pressures between 300 and 450 psi. When the de-methanizer is operated at higher pressures, the objective is to reduce re-compression costs, resulting in lower natural gas liquids recoveries. At lower operating pressures in the de-methanizer, natural gas liquids yields and compression costs are increased. The typical selected mode of operation is based on market value of natural gas liquids. The proposed method allows for an improvement in de-methanizer process operations and production of additional sources of revenue, LNG, and electricity. This method permits selective production of LNG and maximum recovery of natural gas liquids.

The LNG is produced by routing a slipstream from the de-methanizer overhead stream through an expander generator. When the pressure is reduced through a gas expander, the expansion of the gas results in a considerable temperature drop of the gas stream, liquefying the slipstream. The nearly isentropic gas expansion also produces torque and therefore shaft power that can be converted into electricity. A portion of the produced LNG is used as a reflux stream in the de-methanizer, to control tower overhead temperature and hence ethane recovery. Moreover, generating an overhead de-methanizer stream substantially free of natural gas liquids is made possible.

BRIEF DESCRIPTION OF THE DRAWINGS

These and other features of the disclosure will become more apparent from the following description in which reference is made to the appended drawings; the drawings are for the purpose of illustration only and are not intended to in any way limit the scope of the invention to the particular embodiment or embodiments shown.

DETAILED DESCRIPTION

The method will now be described with reference to FIG. 1.

Figure 1:
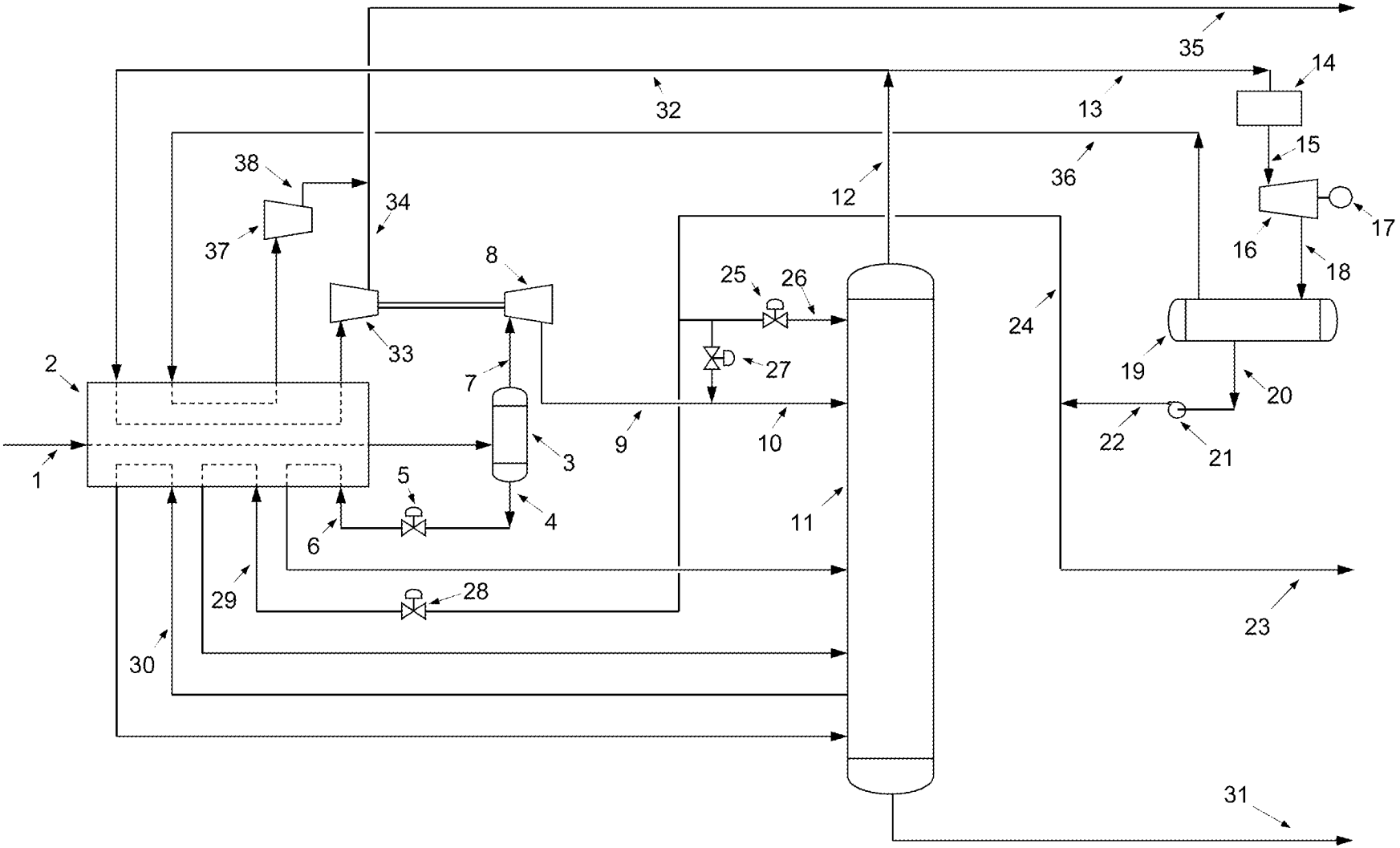
FIG. 1 is a schematic diagram of a facility equipped with a gas expander installed after the de-methanizer overhead stream to produce LNG.

Referring to FIG. 1, a pressurized natural gas stream 1 is routed to heat exchanger 2 where the temperature of the feed gas stream is reduced by indirect heat exchange with counter-current cool streams 6, 29, 30, 32, and 36. The cooled stream 1 enters feed separator 3 where it is separated into vapour and liquid phases. The liquid phase stream 4 is expanded through valve 5 and pre-heated in heat exchanger 2 prior to introduction into de-methanizer column 11 through line 6. The gaseous stream 7 is routed to gas expander 8. The expanded and cooler vapor stream 9 is mixed with LNG for temperature control and routed through stream 10 into the upper section of distillation column 11. The overhead stream 12 from de-methanizer column 11 is split into streams 13 and 32. Stream 13 is routed to gas pre-treatment unit 14 to remove $CO_2$, then through stream 15 enters gas expander 16. Stream 15 pressure is dropped at gas expander 16, the expansion of the gas results in a considerable temperature drop of the gas stream causing it to liquefy upon exiting gas expander 16. The nearly isentropic expansion across the gas expander produces torque and therefore shaft power. The result of this energy conversion process is that the horsepower extracted from the natural gas stream is then transmitted to a shaft that drives an electrical generator 17 to produce electricity. The condensed stream 18 enters vessel 19, the LNG receiver. The gaseous fraction in vessel 19 is routed through stream 36 into heat exchanger 2 to give up its cold, enters compressor 37 and the compressed gas stream 38 is mixed with compressed gas stream 34 to become stream 35 for distribution. LNG is fed through line 20 into pump 21. The pressurized LNG stream 22 feeds streams 23 and 24. Stream 23 is routed to LNG storage. The pressurized LNG stream 24 is routed through reflux temperature control valve 25 providing the reflux stream 26 to de-methanizer column 11. A slipstream from the pressurized LNG stream 24 provides temperature control to stream 9 through temperature control valve 27, temperature controlled stream 10 enters the upper section of de-methanizer column 11. The controlled temperature of stream 10 by addition of LNG enables operation of the de-methanizer column at higher pressures to compensate for the loss of cool energy generated by the expander at higher backpressures. A second slipstream from pressurized LNG stream 24 provides methane for carbon dioxide stripping through flow control valve 28, this LNG stream 29 is pre-heated in heat exchanger 2 before introduction into the lower section of the distillation column 11 as a stripping gas. The liquid fraction stream 30 is reboiled in heat exchanger 2 and routed back to the bottom section of de-methanizer column 11, to control NGL product stream 31. The distilled stream 32, primarily methane, is pre-heated in heat exchanger 2 and routed to compressor 33 for distribution and or recompression through line 34.

Figure 2:
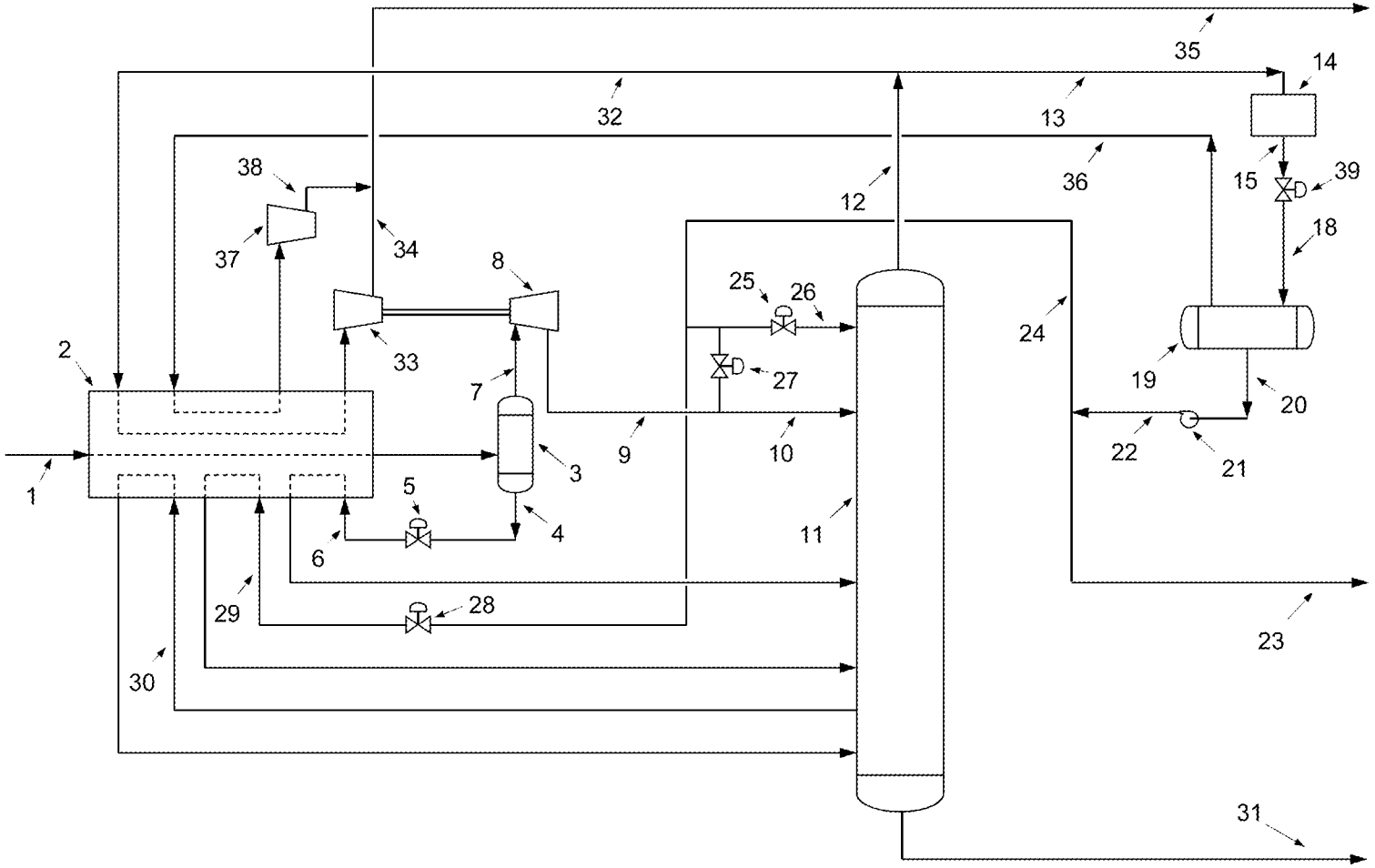
FIG. 2 is a schematic diagram of a facility equipped with a JT valve after the de-methanizer overhead stream to produce LNG.

Referring to FIG. 2, the main difference from FIG. 1 is the substitution of a gas expander to a JT valve 39 to control the pressure drop of stream 15. This process orientation provides an alternative method to produce LNG at NGLs recovery plants albeit less efficient than when using an expander as shown in FIG. 1. A pressurized natural gas stream 1 is routed to heat exchanger 2 where the temperature of the feed gas stream is reduced by indirect heat exchange with counter-current cool streams 30, 29, 6, 32 and 36. The cooled stream 1 enters feed separator 3 where it is separated into vapour and liquid phases. The liquid phase stream 4 is expanded through valve 5 and pre-heated in heat exchanger 2 prior to introduction into distillation column 11 through line 6. The gaseous stream 7 is routed to gas expander 8, the expanded and cooler vapor stream 9 is temperature controlled by LNG addition valve 27, the cooler stream 10 is routed into the upper section of de-methanizer column 11. The overhead stream 12 from de-methanizer column 11 is split into streams 13 and 32. Stream 13 is routed to gas pre-treatment unit 14 to remove $CO_2$, then through stream 15 enters JT valve 39. Stream 15 pressure is dropped through JT valve 39, the expansion of the gas results in a temperature drop of the gas stream causing it to partially condense upon exiting JT valve 39. The partially condensed stream 18 enters vessel 19, the LNG receiver, where the liquid components are separated from the gaseous phase components. The liquid phase stream, LNG, is fed through line 20 into pump 21. The pressurized LNG stream 22 feeds streams 23 and 24. Stream 23 is routed to LNG storage. The pressurized LNG stream 24 is routed through reflux temperature control valve 25 providing the reflux stream 26 to de-methanizer column 11. A slipstream from the pressurized LNG stream 24 provides temperature control to stream 9 through temperature control valve 27, temperature controlled stream 10 enters the upper section of de-methanizer column 11. The controlled temperature of stream 10 by addition of LNG enables operation of the de-methanizer column at higher pressures to compensate for the loss of cool energy generated by the expander at higher backpressures. A slipstream from pressurized LNG stream 24 provides methane for carbon dioxide stripping through flow control valve 28, the LNG stream 29 is pre-heated in heat exchanger 2 before introduction into the lower section of the de-methanizer column 11 as a stripping gas. The liquid fraction stream 30 is reboiled in heat exchanger 2 and routed back to the bottom section of de-methanizer column 11, to control NGL product stream 31. The gaseous stream 36 exits the LNG receiver 19 and is pre-heated in heat exchanger 2, the now warmed gas stream enters compressor 37 and exits through line 38 and mixes with compressed gas stream 34 into natural gas distribution line 35. The distilled stream 32, primarily methane, is pre-heated in heat exchanger 2 and routed to compressor 33 the compressed gas stream 34 is mixed with compressed gas stream 38 for distribution and or recompression through line 35.

In the preferred method, LNG is produced through a gas expander. A portion of the produced LNG provides cold energy that improves the operation and efficiency of NGL de-methanizer columns. Moreover, the gas expander generates electricity which reduces the energy required for recompression of gas for distribution.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the embodiments set forth in the examples, but should be given the broadest interpretation consistent with the description as a whole.

What is claimed is:

1. A method for production of liquid natural gas (LNG) at natural gas liquids (NGLs) recovery plants and improvements to recovery of natural gas liquids from natural gas using LNG, comprising:

providing a pressurized natural gas stream to an NGL recovery plant, the pressurized natural gas stream being diverted from a natural gas pipeline at a pipeline pressure;

operating a de-methanizer column of the NGL recovery plant to produce an overhead stream and an NGL product stream from the pressurized natural gas stream, wherein operating the de-methanizer column comprises at least controlling a temperature within the de-methanizer column;

passing at least a portion of the overhead stream of the de-methanizer column through a carbon dioxide removal unit;

producing LNG at a pressure and temperature below which carbon dioxide condenses by reducing the pressure and temperature of the output of the carbon dioxide removal unit;

transferring a portion of the produced LNG to storage; and using a further portion of the produced LNG as an external cooling source to condition an input stream to the de-methanizer column by directly mixing the portion of the produced LNG with an input stream, the input stream being derived from the pressurized natural gas stream, wherein the temperatures to produce the NGL product stream and the produced LNG are exclusively derived by reducing the pressure of natural gas from the pressurized natural gas stream within the NGL recovery plant.

2. The method as defined in claim 1, where the LNG is produced by reducing the pressure and temperature of the output of the carbon dioxide removal unit through one of a gas expander or JT valve.

3. The method as defined in claim 1, where a further portion of the produced LNG is provided as a reflux stream by a temperature control of an overhead gas stream by mixing of LNG with a rising gas stream in the de-methanizer column.

4. The method as defined in claim 1, wherein the input stream is an un-distilled, expanded, feed gas stream, and wherein the produced LNG is mixed with the input stream to condition the input stream entering the de-methanizer column.

5. The method as defined in claim 1, further comprising the step of preheating LNG and adding the preheated LNG to the de-methanizer column for use as a stripping fluid for reducing a carbon dioxide concentration in the NGL product stream of the de-methanizer column.

6. A method for recovery of natural gas liquids (NGLs) from a natural gas by using a portion of produced liquid natural gas (LNG) at an NGL recovery plant facility, the NGL recovery plant facility having at least one de-methanizer column fed by a feed gas, the method comprising the steps of:

adding the portion of produced LNG from an LNG overhead receiver by directly mixing the LNG and the feed gas prior to being fed to the de-methanizer column to control a temperature profile of an NGL de-methanizer column;

a temperature in an overhead product of the NGL de-methanizer column being controlled by controlling addition of LNG as a reflux stream;

a temperature in the feed gas to the de-methanizer column being controlled by controlling addition of LNG to the feed gas as a tempering fluid; and preheating a stream of LNG and reducing a carbon dioxide concentration in an NGL product stream by controlling the addition of the preheated LNG as stripping fluid to the lower section of the de-methanizer column.

7. The method as defined in claim 6, wherein produced LNG is used to cool an inlet plant gas feed.

8. The method as defined in claim 7, where a gaseous stream from the LNG overhead receiver is used as a source of cooling for the inlet plant gas feed.

9. The method as defined in claim 6, wherein the feed gas to the at least one de-methanizer column is an expanded feed gas.

10. The method as defined in claim 6, wherein a further portion of the produced LNG is used in a heat exchanger to condition the temperature of the feed gas prior to being injected into the de-methanizer column.

11. The method as defined in claim 1, wherein the at least a portion of the overhead stream is passed to the carbon dioxide removal unit at substantially the same pressure as the de-methanizer column.

* * * * *